United States Patent [19]

McCullough

[11] Patent Number: 4,575,937

[45] Date of Patent: Mar. 18, 1986

[54] DEPTH CONTROL GAUGE FOR MEAT TRIMMING KNIFE

[76] Inventor: Timothy J. McCullough, 833 Aurora Rd., Vermilion, Ohio 44089

[21] Appl. No.: 663,499

[22] Filed: Oct. 22, 1984

[51] Int. Cl.[4] ..... B26B 25/00

[52] U.S. Cl. ..... 30/276; 83/286

[58] Field of Search ..... 30/276, 282, 286; 17/1 G; 83/881

[56] References Cited

U.S. PATENT DOCUMENTS

| | | | |
|---|---|---|---|
| 1,781,564 | 11/1930 | Beattie | 30/276 X |
| 3,461,557 | 8/1969 | Behring | 30/276 |
| 3,688,403 | 9/1972 | Bettcher | 30/276 |
| 4,142,291 | 3/1979 | Bettcher | 30/276 |
| 4,166,317 | 9/1979 | Bettcher | 30/276 |
| 4,175,321 | 11/1979 | Bettcher | 30/276 |

*Primary Examiner*—James M. Meister

*Attorney, Agent, or Firm*—Michael Sand Co.

[57] ABSTRACT

A disc-shaped control plate is mounted within the central opening of a ring-shaped cutting blade of a power driven, hand manipulated, meat-trimming knife to control the thickness of portions of meat severed from a larger body of meat. The control plate is mounted on the end of a shaft which is removably mounted on the front end of a handpiece above a blade housing on which the cutting blade is rotatably mounted. A manually operated lever is mounted on the handpiece for raising and lowering the control plate between a depth control position and non-control position. A coil spring biases the control plate toward the lowered control position and a plurality of retention balls are biased by a second spring and retainer cage into a retention groove to maintain the disc in its lowered position until manually raised therefrom by operation of the lever. The position of the control plate is adjustable to regulate the thickness of the meat being severed, and the lever enables the plate to be rendered effectively inoperative when in the raised position which is desirable when severing portions of meat containing a considerably amount of fat from the larger body of meat.

20 Claims, 13 Drawing Figures

FIG. 4
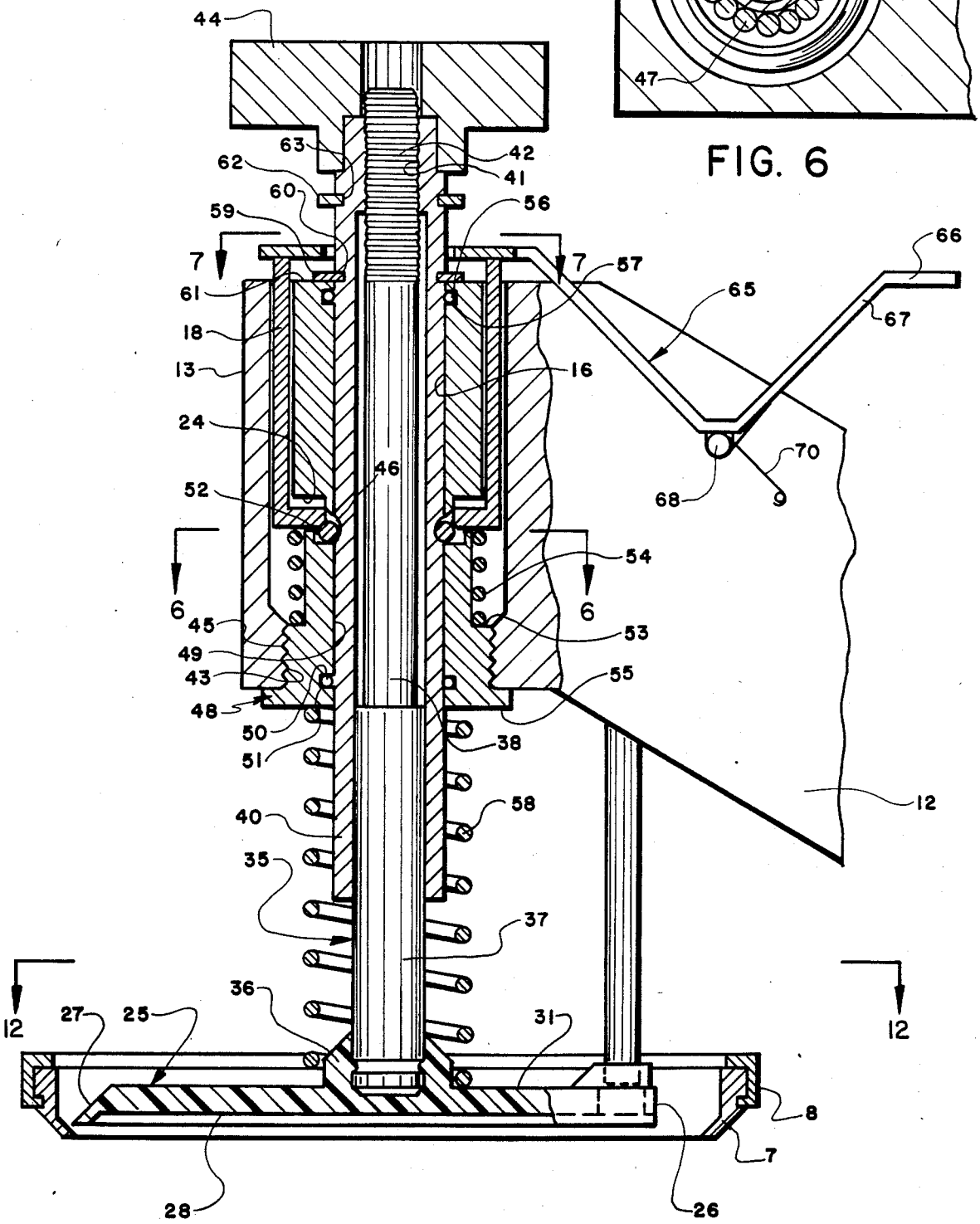
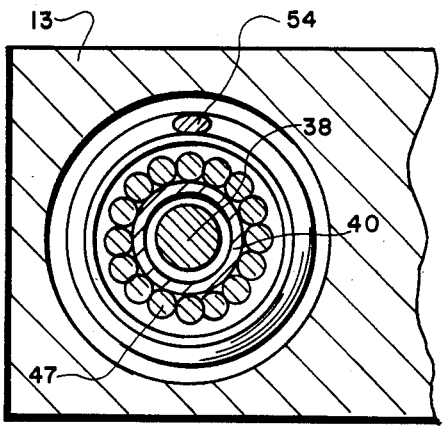
FIG. 6

DEPTH CONTROL GAUGE FOR MEAT TRIMMING KNIFE

TECHNICAL FIELD

The invention relates to meat trimming devices and particularly to manually operated power driven, meat cutting knives used for the quick and easy removable of meat from carcasses and bones. More particularly, the invention relates to a depth control gauge adapted to be movably mounted on the knives for regulating the thickness of meat severed from a carcass, and in which the control gauge can be moved quickly to an inoperative non-control position by the operator when severing other portions of meat from the carcass.

BACKGROUND ART

Various styles of power-driven meat-cutting tools have been devised wherein a ring blade is rotatably mounted on a holder which in turn is mounted on a manually operated, power-driven handle or handpiece. These tools have been used for some time to facilitate the removal of meat from a carcass, primarily in a trimming operation or for removing the meat remains from the bones. These meat-cutting tools are either electrically or pneumatically driven. Some examples of these prior meat-cutting tools are shown in U.S. Pat. Nos. 3,269,010; 3,852,882; 4,170,063; 4,178,683; 4,198,750; and 4,324,043.

These power driven tools or trimming knives as they are generally referred to in the industry, consist of a tubular handpiece terminating in an arcuate shaped front end and formed with a hollow bore extending throughout the longitudinal length thereof. The annular blade holder is attached to the arcuate front end of the handpiece with the ring blade being removably mounted thereon by various mounting arrangements. The blade is formed with gear teeth extending around the top thereof, which are in driving engagement with a pinion gear rotatably mounted within the bore adjacent the front end of the handpiece.

In electrically driven knives a flexible cable, one end of which is connected to a motor located adjacent to the work area, enters the rear of the handle and extends through the bore and terminates in a squared end. The squared end is engaged in a complementary-shaped opening formed in the rear of the pinion gear for rotatably driving the gear. In pneumatically driven knives a squared shaft end of an air motor is engaged in the rear opening of the pinion gear for driving the gear.

These trimming knives have various size diameter blade holders and cutting blades mounted thereon depending upon the particular meat trimming operation for which the knives are to be used.

During the trimming operation, an operator draws the knife across the meat and sections or slices of meat are cut from the main body or carcass. The severed sections pass through the central opening of the blade housing and blade. It has been found that in using such knives, it is difficult to control the depth of the cut of the meat being removed. This results in increased cutting strokes or passes of the knife over the carcass to remove certain portions of the meat, such as in fatty areas, in contrast to other areas where too much lean meat is removed by a single movement of the knife across the carcass. This adversely affects the appearance of the trimmed surface of the meat and removes unwanted meat from the main body reducing the yield of higher quality, more expensive lean meat.

Therefore, the need has existed for a depth control gauge for mounting on such trimming knives in which the operator can preset the gauge to insure that the amount of meat cut from the carcass during each stroke is of a predetermined thickness. Examples of such prior art depth control gauges for such trimming knives are shown in U.S. Pat. Nos. 3,461,557; 3,688,403; 4,166,317; and 4,142,291. Although these prior depth control gauges do perform satisfactorily in certain trimming operations, they possess one serious disadvantage. Once the depth of cut has been manually set by the operator it remains constant until being readjusted by the operator. This readjustment requires the operator to stop the machine and cutting operation and is relatively time consuming.

It is desirable when trimming certain types of meat, especially those having a large amount of fat, that the depth control be inoperative so that deeper cuts and thicker slices of meat containing the greater amount of fat can be severed in a single movement across the carcass. This reduces the number of cutting movements thereby increasing the trimming speed. Also, when trimming the same carcass, once the fat areas have been removed, it is desirable that the depth control gauge become operative to insure that only the required thickness of leaner meat be severed from the carcass during each cutting movement.

There is no known depth control gauge for such meat trimming knives of which I am aware which enables the depth control to be adjusted whereby a predetermined slice thickness can be severed during each movement across the meat and which includes a mechanism for rendering the gauge inoperative, easily and quickly, without stopping the trimming operation.

DISCLOSURE OF THE INVENTION

Objectives of the invention include providing a depth control gauge for a meat trimming knife of the type having an annular blade holder mounted on the front end of a handpiece for rotatably mounting a ring blade thereon and in which the depth control gauge also is mounted on the front end of the handpiece axially above the blade holder and blade and axially movable between a lowered depth control position and a raised noncontrol position by a manually operated lever mounted on the handle of the handpiece. Another objective is to provide such an improved depth control gauge in which a disc-shaped control plate is located within the periphery of the cutting blade and is movably mounted on the front end of the handpiece by a shaft which extends through a mounting member containing a plurality of retention balls which lock the shaft and control plate in the lowered depth control position; and in which the retention balls are released automatically from locking engagement within the shaft upon manipulation of the control lever by the operator.

A further objective of the invention is to provide such an improved depth control gauge in which the control plate is biased into the lowered depth control position by a coil spring telescopically mounted about the plate shaft; in which the control plate is adjustable with respect to the cutting blade by a manually operated adjustment nut to adjust the position of the plate to achieve a desired slice thickness; and in which the control plate returns to the same preset adjusted position upon release of the lever by the operator when placing the control plate in operation within the periphery of the cutting blade. Another objective is to provide such an improved depth control gauge in which the component parts are formed of sanitary plastics or stainless steel and which are easily cleaned and maintained in a sanitary condition; and in which the gauge is adaptable for use on existing handpieces without requiring major modifications thereto and without affecting the manner in which the trimming operation is performed by an operator thereby enabling the operator to continue to trim meat from bones and carcasses in the same manner, yet which provides both a depth control and non-control position almost instantaneously at the discretion of the operator by a simple thumb manipulation of a lever mounted on the handle of the handpiece.

Still another objective of the invention is to provide such an improved depth control gauge for a meat trimming knife in which the accuracy of the portion of meat being cut from the carcass is increased, which enables an improved appearance to be obtained for the trimmed surface, which increases trimming speed by reducing the number of passes of the knife across relatively thick areas of fat, and which enables only the desired thickness of lean meat to be cut from the carcass thereby preventing excess lean meat being removed from the carcass and used as scrap meat instead of the more expensive lean meat portions of the carcass.

Another objective is to provide such an improved depth control gauge for a meat trimming knife which achieves these desired results in an extremely efficient manner, which eliminates difficulties existing in the art, which solves problems, satisfies needs and obtains new results in the art, and which enables an operator to quickly, easily and efficiently use the depth gauge without requiring any appreciable skill for doing the same.

These objectives and advantages are obtained by the improved depth control gauge for a meat trimming knife of the type having a ring-shaped blade holder mounted on the front end of a handpiece with a ring shaped cutting blade having a central opening being rotatably mounted on the blade holder, and in which the general nature of said depth control gauge may be stated as including: depth control plate means adapted to be disposed within the central opening of the cutting blade for controlling the thickness of a section of meat severed from a larger body of meat passing between the plate and cutting blade; mounting means adapted to be attached to the handpiece for movably mounting the plate means on the handpiece for axial movement with respect to the ring-shaped blade opening; and lever means adapted to be pivotally mounted on the handpiece and operatively engageable with the plate means for manually moving the plate means on the mounting means between a lowered depth control position and a raised non-control position.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 4 is an enlarged fragmentary sectional view taken on line 4—4, FIG. 1, with the depth control plate being shown in the lowered depth control position;

FIG. 6 is a fragmentary sectional view taken on line 6—6, FIG. 4;

Similar numerals refer to similar parts throughout the drawings.

BEST MODE FOR CARRYING OUT THE INVENTION

Figure 1:
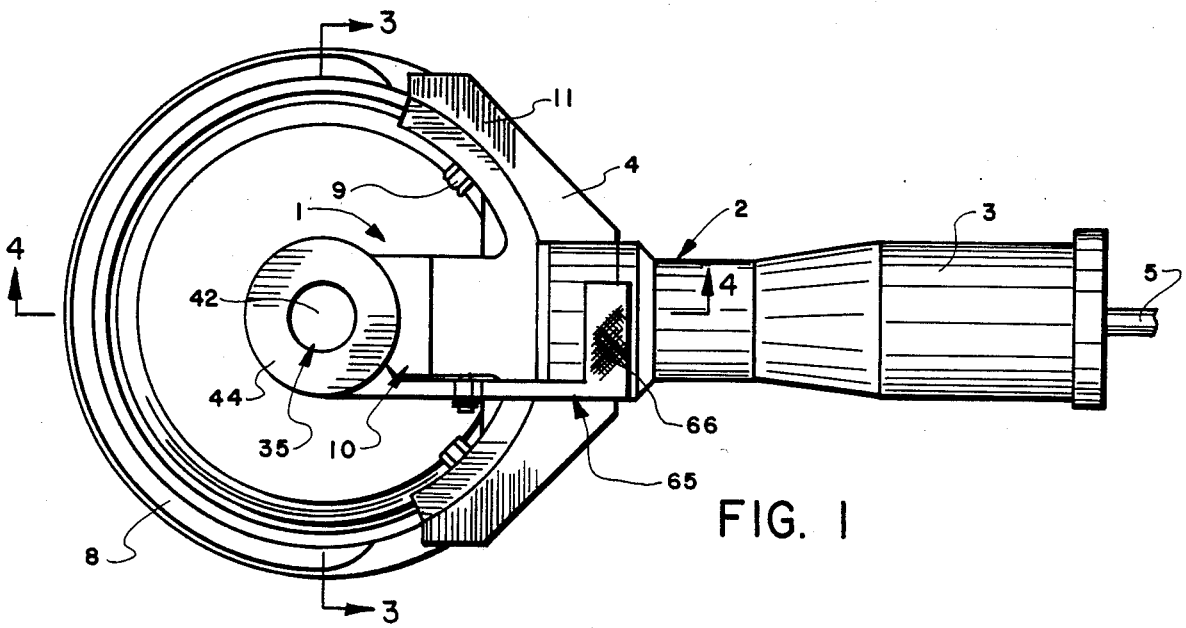
FIG. 1 is a top plan view of the improved depth control gauge mount on a power driven meat trimming knife.
Figure 2:
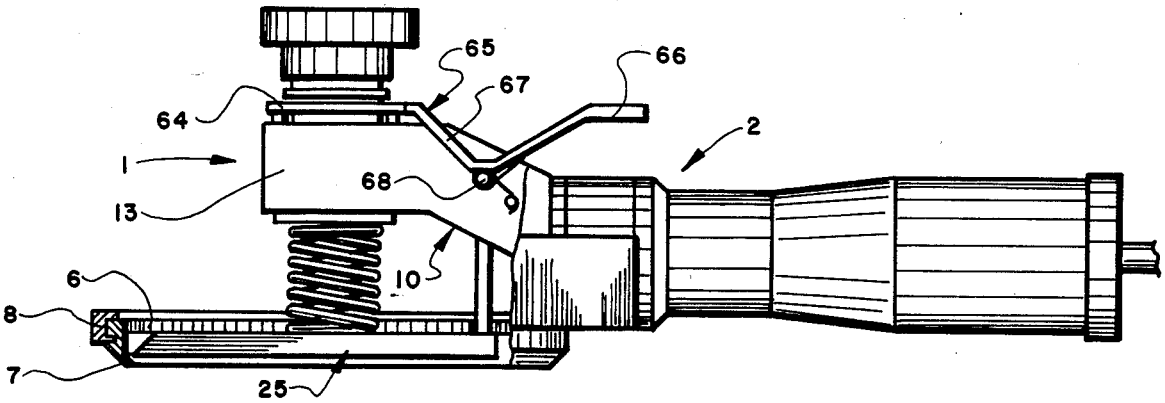
FIG. 2 is a side elevational view of the improved depth control gauge and trimming knife of FIG. 1, with portions broken away and in section.
Figure 3:
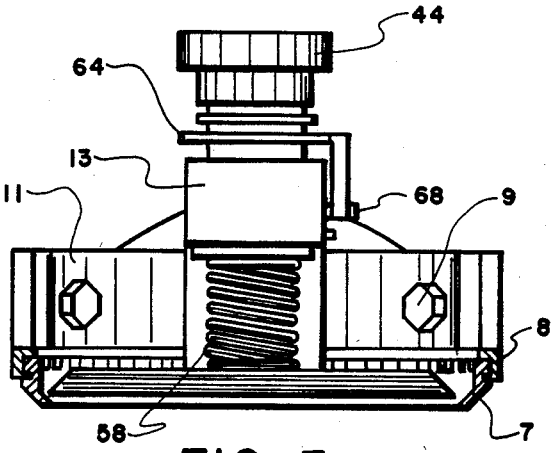
FIG. 3 is a sectional view taken on line 3—3, FIG. 1.

The improved depth control gauge is indicated generally at 1, and is shown particularly in FIGS. 1, 2, and 3 mounted on a usual meat trimming knife which is indicated generally at 2. Knife 2 is illustrated as being a usual electric driven knife having a handle 3 extending outwardly rearwardly from an arcuate-shaped blade attachment front end portion 4. Knife 2 is adapted to be connected to an electric motor by a flexible drive cable 5. The electric motor for driving cable 5 is usually supported by a hanger closely adjacent a work table on which the meat trimming operation is being performed. If desired, knife 2 may be pneumatically driven having an air driven motor mounted within the handle.

A rotatably mounted pinion gear (not shown) is mounted within front end 4 of the handpiece and is driven by cable 5 or a pneumatic motor. The pinion gear meshingly engages gear teeth 6 formed about the peripheral top surface of a ring-shaped cutting blade, indicated generally at 7. Blade 7 is rotatably mounted in a ring-shaped blade housing 8 which is mounted on arcuate shaped front end 4 by a pair of attachment bolts 9. Knife 2 may be of the type shown in U.S. Pat. Nos. 3,024,532; 3,269,010; 3,852,882; 4,324,043; and 4,363,170.

Figure 5:
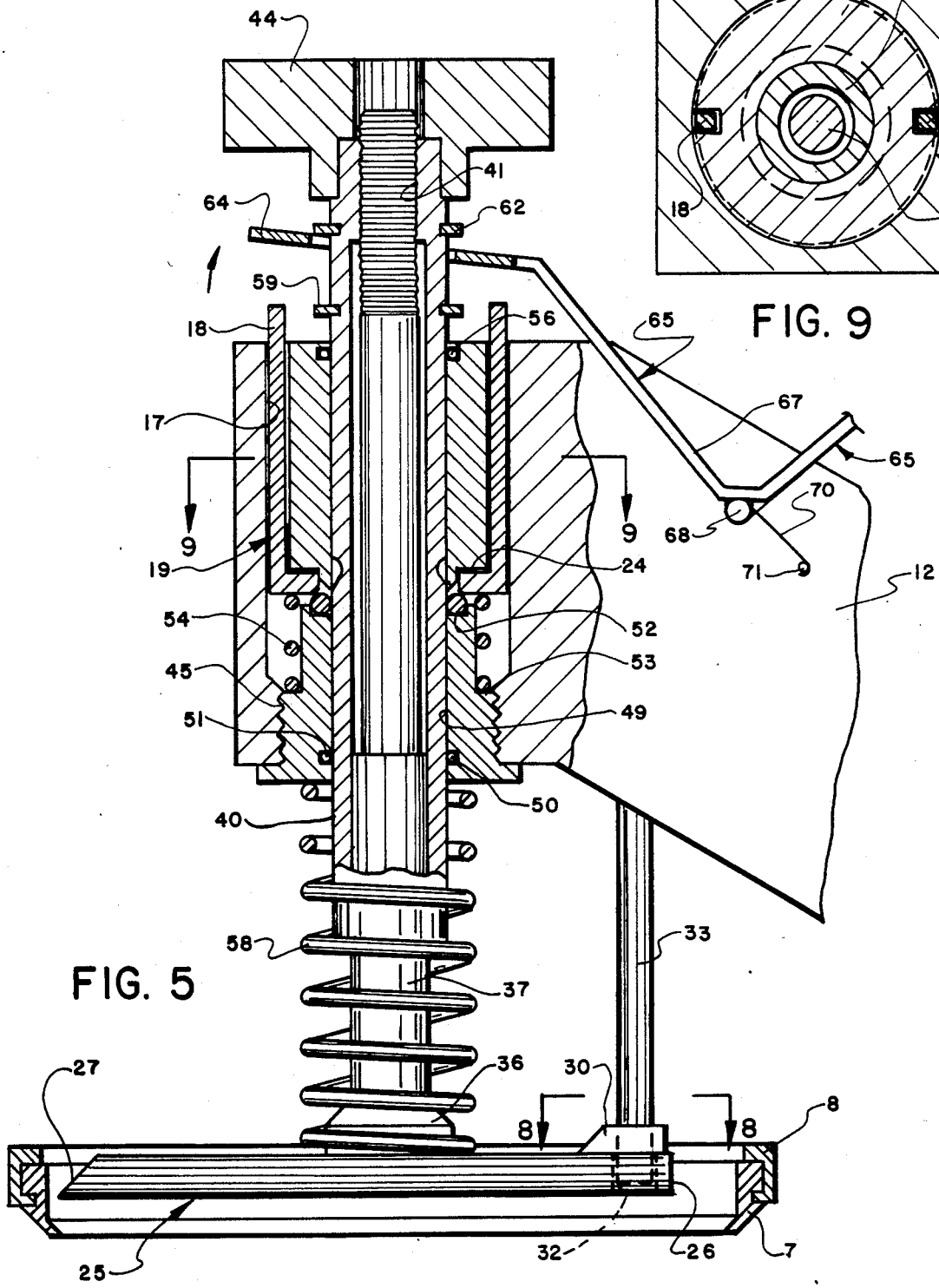
FIG. 5 is a sectional view similar to FIG. 4 with the depth control plate being shown in a raised positioned.
Figure 10:
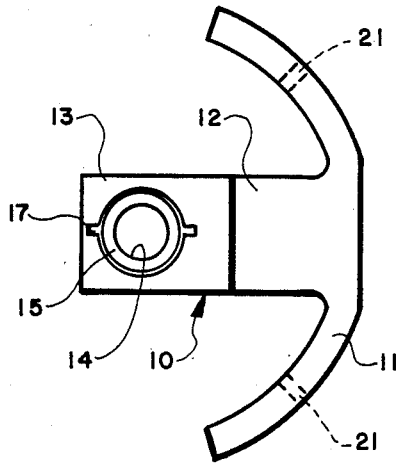
FIG. 10 is a top plan view of the main body portion of the improved control gauge.

Improved depth control gauge 1 is illustrated in section in FIGS. 4 and 5. Control gauge 1 includes a main body indicated generally at 10 (FIG. 10), which includes an arcuate-shaped mounting flange 11 which is complementary to the concaved inner surface of front end 4 of trimming knife 2. Body 10 may be attached to front end 4 by blade holder mounting bolts 9 (FIG. 3) which extend through a pair of holes 21 formed in flange 11. However, other types of mounting flanges and arrangements may be used for mounting control gauge 1 on various styles of trimming knives without effecting the concept of the invention. Body 10 further includes an angular portion 12 which terminates in a front body portion 13 (FIG. 10).

Figure 9:
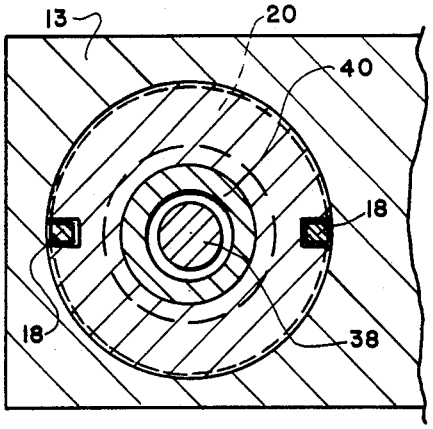
FIG. 9 is a fragmentary sectional view taken on line 9—9, FIG. 5.
Figure 11:
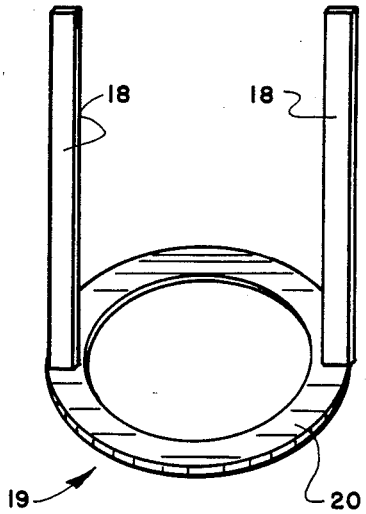
FIG. 11 is an enlarged perspective view of the ball retention cage.
Figure 12:
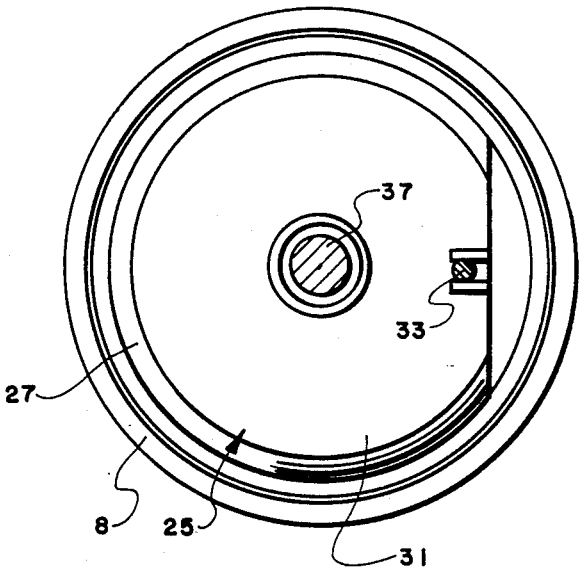
FIG. 12 is a reduced sectional view taken on line 12—12, FIG. 4.
Figure 7:
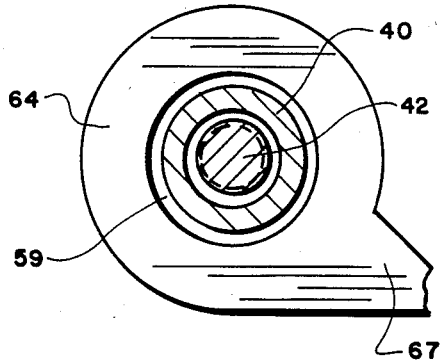
FIG. 7 is a sectional view taken on line 7—7, FIG. 4.

Front body portion 13 is formed with a central opening 14 having a bronze bearing bushing 15 press fitted therein (FIGS. 4 and 5). A pair of diametrically opposite keyways 17 (FIGS. 9 and 10) are formed in the outer periphery of bushing 15 for receiving legs 18 of a retainer cage, indicated generally at 19 (FIG. 11). Cage 19 includes a bottom ring 20 preferably formed integrally with legs 18. The lower end of bushing 15 is formed with an annular recess 24 for receiving cage ring 20 therein when the depth control gauge is in the raised non-operative position as shown in FIG. 5.

Depth control gauge 1 further includes a control plate, indicated generally at 25, having a generally disc-shaped configuration except for a straight rear end portion 26. Control plate 25 preferably is formed of a plastic material and has a upwardly inwardly extending conical side surface 27 and a concave bottom surface 28.

Figure 8:
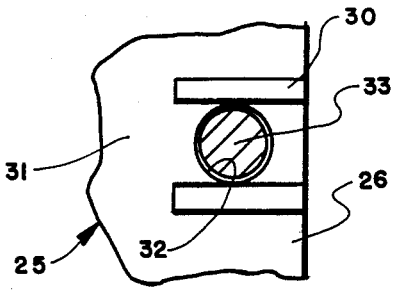
FIG. 8 is a fragmentary sectional view taken on line 8—8, FIG. 5.

A pair of spaced flanges 30 are formed on top surface 31 of control plate 25 FIGS. 5 and 8) adjacent a hole 32 formed in the plate for receiving a stabilizing rod 33. Rod 33 is connected to angled body portion 12 of main body 10 and extends downwardly therefrom and extends between flanges 30 and into hole 32 to prevent rotational movement of plate 25 upon the meat contacting concave bottom surface 28 and passing between cutting blade 7 and conical surface 27 generally throughout the front end portion of the trimming knife.

A shaft 35 is attached to control plate 25 preferably at the center thereof and extends perpendicularly upwardly therefrom as shown particularly in FIG. 4. Shaft 35 may be molded within a circular central boss 36 of plate 25 or may be secured by other attachment means. Shaft 35 preferably has an enlarged lower section 37 and a reduced diameter upper section 38 and is telescopically slidably mounted within an outer tubular sleeve 40. Sleeve 40 preferably has an internal diameter generally complementary to the outer diameter of lower section 37 of shaft 35 as shown in FIGS. 4 and 5.

Tubular sleeve 40 has an internally threaded upper bore 41 which is engaged with an upper threaded section 42 of control plate shaft 35. A manually operated adjustment nut 44 is secured to the top end of tubular sleeve 40 (FIG. 4) whereby manual rotation of nut 44 will rotate sleeve 40 causing axial raising and lowering movement of connected shaft 35. Since shaft 35 and connected plate 25 are prevented from rotation by stabilizing rod 33, rotation of sleeve 40 will move shaft 35 axially within the sleeve because of the threaded connection therebetween. Adjustment nut 44 thus provides for the axial adjustment of control plate 25 with respect to cutting blade 7.

Figure 13:
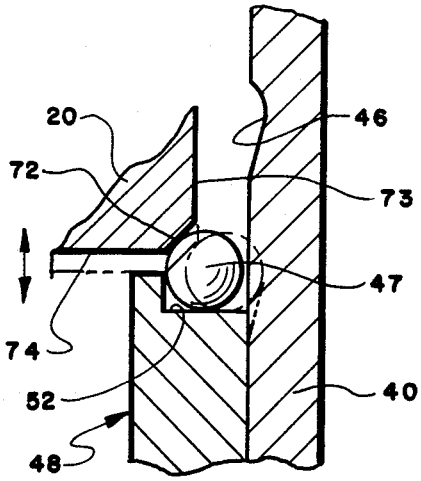
FIG. 13 is an enlarged fragmentary sectional view of one of the retaining balls and associated locknut and retaining cage.

A concave groove 46 is formed in the outer surface of tubular sleeve 40 generally immediate the upper and lower ends thereof for receiving a plurality of retention balls 47. Balls 47 are arranged in a circular manner about sleeve 40 and are maintained adjacent to groove 46 by an annular lock nut 48 (FIGS. 4, 6, and 13). Lock nut 48 has a central opening 49 in which shaft 40 is telescopically slidably engaged. A sealing O-ring 50 is mounted within inner annular groove 51 formed in the lock nut adjacent opening 49 to prevent contaminates from entering between the outer surface of tubular sleeve 40 and opening 49 of lock nut 48 to affect the sliding engagement therebetween. Lock nut 48 is maintained in an adjusted position on main body 10 by the engagement of an exterior threaded section 45 with an interior threaded bore portion 43 formed at the lower end of front body portion 13 (FIGS. 4 and 5). An annular recess 52 is formed in the top surface of lock nut 48 for supporting and maintaining balls 47 in position adjacent sleeve 40. An annular shoulder 53 is formed on the exterior of lock nut 48 above threaded section 51 for supporting a coil compression spring 54 thereon which engages ring 20 of cage 19 biasing cage 19 in an upward direction.

Another sealing O-ring 56 is mounted within an annular groove 57 formed in the bore 16 of bushing 15 to prevent contaminates from entering between bushing bore 16 and the outer surface of tubular sleeve 40 to affect the sliding engagement therebetween. A retaining washer 59 is located within an annular groove 60 formed in the outer surface of sleeve 40 adjacent the top annular surface 61 of bushing 15 to limit the downward movement of sleeve 40 and adjustably mounted shaft 35 with respect to front portion 13 of body 10. Another washer 62 is mounted a predetermined distance above washer 59 within an annular groove 63 for lifting engagement with a ring-shaped end 64 of a lever indicated generally at 65.

Control plate 25 is baised toward its adjusted position with respect to blade 7 by a coil spring 58 which is abuttingly engaged with top surface 31 of plate 25 and annular bottom surface 55 of lock nut 48.

Lever 65 includes a thumb operated end 66 connected to end 64 by an angled intermediate portion 67 which is pivotally mounted on inclined body portion 12 of main body 10 by a pivot pin 68. A leaf spring 70 is retained at one end by a pin 71 and is connected at its other end to lever 65 biasing lever 65 in a counterclockwise position when viewing FIGS. 4 and 5 maintaining lever end 64 engaged with the top edges of cage legs 18 forcing cage ring 20 into engagement with retention balls 47 and correspondingly moving balls 47 into sleeve groove 46 (FIG. 4).

The operation and manner of use of the improved depth control gauge is set forth below. An operator will manually adjust the position of depth control plate 25 with respect to the cutting edge of blade 7 by rotation of adjustment nut 44. The axial position of depth control plate 25 will determine the clearance or separation between the circular edge of plate 25 formed at the junction of bottom surface 28 and conical side surface 27 as shown in FIG. 4. This spacing will determine the thickness of the meat severed from the main body of meat or carcass upon the operator moving the knife across the meat. Once this initial setting has been made, the operator need not readjust the position of plate 25 with respect to blade 7 until a different thickness slice is desired which will be dependent upon the particular trimming operation being performed by the operator.

The depth control gauge will be maintained in the lowered preset control position as shown in FIG. 4 due to the biasing action of lever spring 70 which presses downwardly on cage 19 which forces retention balls 47 into groove 46 which locks sleeve 40, shaft 35 and plate 25 in their lowered positions. In this lowered control position, retention balls 47 will be forced into sleeve groove 46 by the tapered edge 72 of cage ring 20 as shown in FIG. 13. Edge 72 is an annular edge which joins cylindrical side wall 73 and annular bottom wall 74 of cage ring 20. The engagement of angled surface 72 with retention balls 47 will move the balls into groove 46 completely about sleeve 40.

Cage ring 20 is forced in a downward direction so that surface 72 will engage balls 47 and move them into groove 46 since the downward biasing force exerted by leaf spring 70 of lever 65 is greater than the upward biasing force exerted by coil spring 54 against cage ring 20. Thus, the biasing force exerted by lever 65 against cage 19 will force the retention balls into the retaining groove of sleeve 40 preventing any axial upward movement of sleeve 40 and connected shaft 35 until lever 65 is pivotally moved out of engagement with the outer ends of cage legs 18. This positive retention or locking of the depth control plate 25 and connected shaft 35 and sleeve 40 prevents control plate 25 from moving axially upwardly due to the pressure of the meat pressing against concave bottom surface 28 of the plate during a cutting operation. Control plate 25 also is prevented from any further axial downward movement by retaining washer 59 until manually moved in either the downward or upward direction by adjustment nut 44.

The operator will perform his usual trimming operation with control plate 25 in the down position of FIG. 4, with plate 25 regulating the depth or thickness of the meat slice being cut from the carcass without any additional manipulation or procedure. However, in accordance with one of the main features of the invention, improved depth control gauge 1 enables the operator to almost instantaneously move depth control gauge out of its depth control position. This raised position enables a thicker slice to be severed from the meat which is particularly desirable when trimming areas of the meat having an excess amount of fat. With prior depth control trimming knives these fat areas required repeated movements of the trimming knife across the meat to remove the excess fat. The operator merely depresses lever end 66 in a downward direction toward the body of the handpiece with his thumb, even while the knife is energized and blade 7 rotating in a usual manner.

Referring again to FIGS. 4 and 5, this downward movement of lever end 66 will move ring-shaped lever end 64 in the upward direction whereupon ring end 64 will engage projecting washer 62 which will slidably move sleeve 40 and attached shaft 35 axially upwardly from the depth control position to FIG. 4 to the raised non-controlled position of FIG. 5. This upward movement is possible since immediately upon the upward movement of lever end 64, the biasing force of coil spring 54 will move cage ring 20 axially upwardly with ring 20 entering into an annular recess 24 formed in the bottom surface of bushing sleeve 15. This enables the upward movement of sleeve 40 to force or move retention balls 47 out of groove 46 and completely into annular groove 52 formed in the top surface of lock nut 48 (FIG. 13). Thus, the downward pivotal movement of lever end 66 will raise lever end 64 upwardly to manually lift slide plate 25 and connected shaft 35 and sleeve 40 upwardly until cage ring 20 abuts against the bottom of annular recess 24 formed in the lower end of bushing 15. The further sleeve 40, shaft 35 and plate 25 are moved upwardly, thicker will be the amount of meat severed from the carcass during each pass or movement of the trimming knife across the carcass. However, once plate 25 is raised a relatively short axially distance above the cutting edge of blade 7, as shown in FIG. 5, it effectively becomes inoperative as to regulating the thickness of the slice being cut from the carcass. Even though the depth control plate 25 is still located within the periphery of the cutting blade when in the raised position, it has minimal effect as to regulating the depth of cut in contrast to the depth control provided thereby when in the lowered position of FIG. 4.

Immediately upon the operator removing the thicker slices of meat containing excess fat from a carcass, he merely releases the downward pressure on lever end 66 whereupon spring 70 will move lever ring end 64 in a downward direction. End 64 will contact the washer 59 of sleeve 40 and the top edges of cage legs 18 moving sleeve 40 and cage 19 axially downwardly whereupon angled corner or edge 72 of cage ring 20 will engage the retention balls moving the same inwardly into adjacent groove 46 (FIG. 13) again locking the depth control plate in the lowered control position of FIG. 4. Immediately upon ring end 64 being moved downwardly and out of engagement with washer 62 and balls 47 moving into groove 46, the biasing force of coil spring 58 will move control plate 25 and connected shaft 35 and sleeve 40 downwardly even without ring end 64 contacting washer 59, returning plate 25 to its preadjusted depth control position of FIG. 4 without requiring any other operation on the part of the operator.

The above described procedure can be performed almost instantaneously by the operator during a trimming operation without difficulty and without requiring any additional skill on the operator's part, and without materially changing or modifying the usual trimming procedure. Therefore, improved depth control 1 provides a device adapted to be attached to a usual trimming knife which enables an operator to have a preset depth control gauge for regulating the size of meat being trimmed from a carcass, which enables the operator to immediately remove the depth control feature or effect from the knife when trimming certain portions of the carcass, and in which the depth control plate can be returned almost instantaneously to its preset control position by a simple manipulation of a lever located immediately adjacent the handle portion of the trimming knife and operated preferably by the operator thumb with only a minimal amount of pressure sufficient to overcome the biasing force of the lever spring.

The various components of depth control gauge 1 preferably will be formed of plastic such as disc 25 and retention balls 47 with other components being formed of stainless steel. Thus, the use of stainless steel and plastic enables the device to be maintained in a sanitary condition which is required for products coming into contact with meat being processed for human consumption. Another advantage is that depth control gauge 1 can be mounted on and removed from existing styles of handpieces by a pair of attachment bolts 9 or other mounting arrangements, depending upon the particular style handpiece on which the depth control gauge is mounted, enabling the depth control gauge to be adapted for use with existing trimming knives, and when desired with the knife being used for a usual trimming procedure without the depth control as a part thereof.

Accordingly, the improved depth control gauge is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved depth control gauge for meat trimming knives is constructed and used, the characteristics of the construction, and the advantageous, new and useful results obtained; the new and useful structures, devices, elements, arrangements, parts, and combinations, are set forth in the appended claims.

What is claimed is:

1. An improved depth control gauge for use with a meat trimming knife of the type having a ring-shaped blade holder mounted on the front end of a handpiece with a ring-shaped cutting blade having a central opening being rotatably mounted on the blade holder; said depth control gauge including:

(a) depth control plate means adapted to be disposed within the central opening of the cutting blade for controlling the thickness of a section of meat severed from a larger body of meat passing between the plate means and cutting blade;

(b) mounting means adapted to be attached to the handpiece for movably mounting the plate means on the handpiece for axial movement with respect to the ring-shaped blade opening; and (c) lever means adapted to be pivotally mounted on the handpiece and operatively engageable with the plate means for manually moving the plate means on the mounting means between a lowered depth control position and a raised non-control position.

2. The depth control gauge defined in claim 1 in which the mounting means includes spring means for biasing the control plate means toward the lowered depth control position.

3. The depth control gauge defined in claim 1 in which the lever means includes a lever having first and second ends, and a pivot pin intermediate said ends pivotally mounting the lever on the handpiece; in which the first end is operatively engaged with the depth control plate means for axially moving said control plate means with the second end being adapted to be manually operated by an operator for moving the control plate means by its engagement with the first end of the lever; and in which spring means is engaged with the lever for biasing the lever into operative engagement with the control plate means.

4. The depth control gauge defined in claim 3 in which the control plate means includes a control plate, a shaft attached to and extending generally perpendicular from said plate and a sleeve telescopically mounted about and adjustably attached to the shaft; and in which the first lever end engages the telescopically mounted shaft from moving the shaft and control plate from the lowered position to the raised position.

5. The depth control gauge defined in claim 4 in which stabilizer means extends between the handpiece and control plate for stabilizing said plate in the raised and lowered positions by preventing rotation of said control plate.

6. The depth control plate defined in claim 5 in which the stabilizing means includes a rod attached to the handpiece and projecting toward aligned opening means formed in the control plate; and in which said opening means receives the rod therein as the control plate moves between the raised and lowered positions.

7. The depth control gauge defined in claim 1 in which the control plate means includes a generally disc-shaped plate, a shaft attached generally to the center of said plate and extending perpendicularly therefrom, and a sleeve telescopically mounted about and attached to the control plate shaft; in which a retention groove is formed in the outer periphery of the sleeve; in which a plurality of retention balls are located adjacent the sleeve retention groove; and in which axially movable cage means is telescopically mounted about the sleeve for maintaining the retention balls in the retention groove when the control plate is in the lowered control position to maintain the control plate in said lowered control position.

8. The depth control gauge defined in claim 7 in which the mounting means includes a main body adapted to be mounted on the front end of the handpiece, said body being formed with a central opening generally concentric with the axis of the ring-shaped cutting blade; in which the ball retention cage means is movably mounted within the main body concentric with the central opening; in which spring means is mounted within the central body and is engageable with the cage means to bias the cage means away from the ball retention position; and in which the lever means maintains the cage means in the ball retention position until the lever means is moved out of engagement with said cage means.

9. The depth control gauge defined in claim 8 in which the lever means includes a spring which biases the lever means into engagement with cage means; and in which the cage means biasing spring exerts a smaller force on the cage means than the biasing force exerted on the cage means by the lever means spring means.

10. The depth control gauge defined in claim 9 in which a bushing is telescopically mounted within the central opening of the main body; in which the sleeve of the depth control plate means is slidably mounted within the bushing; in which the cage means includes a cage having an end ring engageable with the retention balls and a pair of leg extending from the end ring and located within keyways formed in the main body; and in which the lever means is engageable with the cage legs for moving the cage into and out of engagement with the retention balls.

11. The depth control gauge defined in claim 10 in which projection means is mounted on the depth control means sleeve and is engageable with the lever means for axially moving the depth control means out of the lowered depth control position upon manual actuation of the lever means.

12. The depth control gauge defined in claim 11 in which the projection means is a washer mounted on the depth control means sleeve.

13. The depth control gauge defined in claim 7 in which the depth control shaft is threadably engaged with the sleeve for manually adjusting the shaft with respect to the sleeve for regulating the distance of the control plate from the cutting blade to control the thickness of the slices of meat severed by the blade from a body of meat.

14. The depth control gauge defined in claim 10 in which the ball retention ring of the cage has an annular end wall and a cylindrical side wall joined by an angled corner; and in which said angled corner engages the retention balls as the ring is moved from the raised position to the lowered control position to move said balls into the retention groove of the sleeve.

15. The depth control gauge defined in claim 10 in which the retention balls are supported within an annular recess formed in a lock nut; and in which the lock nut is adjustably mounted on the main body and is engaged by a coil spring which biases the control plate toward the lowered control position.

16. The depth control gauge defined in claim 7 in which the control plate has a concave bottom surface and a downwardly outwardly tapered outer surface extending throughout much of the periphery of the control plate.

17. An improved meat trimming knife for cutting sections of meat from a body of meat, said knife including:

(a) a handpiece having a handle, a ring-shaped blade holder mounted on a front end of the handpiece and a ring-shaped cutting blade rotatably mounted on said blade holder, said blade holder and cutting blade having a common axial opening;

(b) depth control plate means mounted on the handpiece and partially disposed within the common axial opening of the blade holder and blade for regulating the thickness of severed sections of meat cut from the body of meat and passing between the cutting blade and portions of the control plate means; and (c) manually manipulated lever means mounted on the handpiece and operatively engageable with the depth control plate means for axially moving said plate means between a lowered depth control position and a raised position.

18. The meat trimming knife defined in claim 17 in which the depth control plate means includes a control plate, a shaft attached to the control plate, a sleeve telescopically mounted about the shaft and adjustably connected thereto, and retention means for retaining the control plate in the lowered depth control position; and in which the lever means includes a lever pivotally mounted on the handpiece and engageable with the retention means when the control plate is in the lowered position and alternatively engageable with the sleeve to move the sleeve and control plate axially from the lowered to the raised position.

19. The meat trimming knife defined in claim 18 in which the lever means further includes a spring which biases the lever into engagement with the retention means until manually moved into engagement with the sleeve; and in which the depth control plate means further includes a coil spring engaged with the plate biasing the plate toward the lowered position.

20. The meat trimming knife defined in claim 19 in which the retention means includes a plurality of retention balls located adjacent an annular groove formed in the sleeve, a retention cage having a circular ring engaged with the balls and a pair of legs extending from said ring and engageable by the lever to force the balls into the sleeve groove to lock the sleeve and control plate in the lowered position; and in which a second coil spring biases the retention cage towards disengagement from the retention balls, with the biasing force exerted by said second coil spring being less than the biasing force exerted by the lever spring.

* * * * *